US009157272B2

(12) United States Patent
Rupel

(10) Patent No.: US 9,157,272 B2
(45) Date of Patent: Oct. 13, 2015

(54) CELLULAR SHADE HAVING AT LEAST TWO CELLULAR COLUMNS

(71) Applicant: Hunter Douglas, Inc., Pearl River, NY (US)

(72) Inventor: John D. Rupel, Pine River, WI (US)

(73) Assignee: Hunter Douglas, Inc., Pearl River, NY (US)

( * ) Notice: Subject to any disclaimer, the term of this patent is extended or adjusted under 35 U.S.C. 154(b) by 29 days.

(21) Appl. No.: 14/010,804

(22) Filed: Aug. 27, 2013

(65) Prior Publication Data

US 2014/0060755 A1 Mar. 6, 2014

Related U.S. Application Data

(62) Division of application No. 12/985,971, filed on Jan. 6, 2011, now abandoned.

(51) Int. Cl.

| | |
|---|---|
| ***A47H 5/00*** | (2006.01) |
| ***E06B 3/48*** | (2006.01) |
| ***E06B 3/94*** | (2006.01) |
| ***E06B 9/06*** | (2006.01) |
| ***E06B 9/262*** | (2006.01) |

(52) U.S. Cl.

CPC ..... *E06B 9/262* (2013.01); *E06B 2009/2627* (2013.01); *Y10T 29/49826* (2015.01)

(58) Field of Classification Search

CPC ..... E06B 9/262; E06B 2009/2622; E06B 2009/2625; E06B 9/2627

USPC ..... 160/115, 84.01, 84.03, 84.04, 84.05; 428/116, 118

See application file for complete search history.

(56) References Cited

U.S. PATENT DOCUMENTS

| | | | |
|---|---|---|---|
| 2,201,356 | A | 5/1940 | Terrell |
| 3,487,875 | A | 1/1970 | Shukat et al. |
| 4,069,857 | A | 1/1978 | Brookshire |
| 4,388,354 | A | 6/1983 | Suominen |
| 4,397,346 | A | 8/1983 | Chumbley et al. |
| D277,061 | S | 1/1985 | Picoy |

(Continued)

FOREIGN PATENT DOCUMENTS

| | | |
|---|---|---|
| EP | 0427477 A2 | 5/1991 |
| GB | 2236551 | 4/1991 |

(Continued)

OTHER PUBLICATIONS

International Search Report, PCT/US2012/020267, Mailed May 4, 2012, 2 pages.

(Continued)

*Primary Examiner* — Katherine Mitchell
*Assistant Examiner* — Jeremy Ramsey
(74) *Attorney, Agent, or Firm* — Dority & Manning, P.A.

(57) ABSTRACT

An expandable and contractable shade assembly includes at least a first column of cell structures aligned vertically one above another and a second column of cell structures also aligned vertically one above the other. The second column of cell structures can be positioned offset and nested with the first cell structures such that each second cell structure may be positioned in between two adjacent of the first cell structures. One or more lift cords may be encased or contained within the first cell structures. The first cell structures not only have lift cords but also provide the product with added integrity.

27 Claims, 8 Drawing Sheets

(56) References Cited

U.S. PATENT DOCUMENTS

| | | | | | |
|---|---|---|---|---|---|
| 4,542,602 | A | | 9/1985 | Hoverson | |
| 4,603,072 | A | | 7/1986 | Colson | |
| 4,677,012 | A | | 6/1987 | Anderson | |
| 4,732,630 | A | | 3/1988 | Schnebly | |
| 4,861,404 | A | | 8/1989 | Neff | |
| 4,921,032 | A | | 5/1990 | May | |
| 5,090,098 | A | | 2/1992 | Seveik et al. | |
| 5,129,440 | A | | 7/1992 | Colson | |
| 5,228,936 | A | | 7/1993 | Goodhue | |
| 5,313,998 | A | * | 5/1994 | Colson et al. | 160/84.02 |
| 5,339,882 | A | | 8/1994 | Judkins | |
| 5,425,408 | A | | 6/1995 | Colson | |
| 5,503,210 | A | * | 4/1996 | Colson et al. | 160/84.05 |
| 5,547,006 | A | | 8/1996 | Auger | |
| 5,560,976 | A | | 10/1996 | Huang | |
| 5,566,735 | A | | 10/1996 | Jelic | |
| 5,620,035 | A | | 4/1997 | Judkins | |
| 5,649,583 | A | | 7/1997 | Hsu | |
| 5,690,156 | A | | 11/1997 | Ruggles | |
| 5,691,031 | A | | 11/1997 | Swiszcz et al. | |
| 5,692,550 | A | * | 12/1997 | Ford et al. | 160/84.05 |
| 5,701,940 | A | * | 12/1997 | Ford et al. | 160/84.05 |
| 5,706,876 | A | | 1/1998 | Lysyj | |
| 5,746,266 | A | | 5/1998 | Colson et al. | |
| 5,753,338 | A | | 5/1998 | Jelic et al. | |
| 5,787,951 | A | | 8/1998 | Tonomura et al. | |
| 5,834,090 | A | * | 11/1998 | Huang | 428/116 |
| 5,837,084 | A | * | 11/1998 | Barss | 156/197 |
| 6,033,504 | A | | 3/2000 | Judkins | |
| 6,068,039 | A | | 5/2000 | Judkins | |
| 6,257,300 | B1 | | 7/2001 | Brownlie | |
| 6,497,264 | B1 | | 12/2002 | Paskevicius | |
| 6,520,238 | B2 | | 2/2003 | Allsopp | |
| 6,527,895 | B1 | | 3/2003 | Palmer | |
| 6,572,725 | B2 | | 6/2003 | Goodhue | |
| 6,662,845 | B1 | | 12/2003 | Palmer | |
| 6,767,615 | B1 | | 7/2004 | Judkins et al. | |
| D498,105 | S | | 11/2004 | Tyner | |
| 6,932,138 | B2 | | 8/2005 | Yu et al. | |
| 6,988,526 | B2 | | 1/2006 | Judkins | |
| 7,021,359 | B2 | | 4/2006 | Yu et al. | |
| 7,124,802 | B2 | | 10/2006 | Sudano | |
| 7,131,479 | B1 | | 11/2006 | Marusak et al. | |
| 7,159,634 | B1 | | 1/2007 | Judkins | |
| 7,275,580 | B2 | | 10/2007 | Yu et al. | |
| 7,290,582 | B2 | | 11/2007 | Lin | |
| 7,353,856 | B2 | | 4/2008 | Pon et al. | |
| D568,082 | S | | 5/2008 | Bohlen | |
| 7,404,428 | B2 | | 7/2008 | Sun et al. | |
| 7,415,845 | B1 | | 8/2008 | Graichen | |
| 7,481,076 | B2 | | 1/2009 | Windisch et al. | |
| 7,513,292 | B2 | | 4/2009 | Auger et al. | |
| 7,523,777 | B2 | | 4/2009 | Kim | |
| 2006/0027336 | A1 | | 2/2006 | Lin | |
| 2006/0219369 | A1 | | 10/2006 | Yu et al. | |
| 2006/0225846 | A1 | | 10/2006 | Marusak et al. | |
| 2006/0243395 | A1 | | 11/2006 | Liang | |
| 2006/0251855 | A1 | | 11/2006 | Yu | |
| 2006/0254726 | A1 | | 11/2006 | Lin | |
| 2007/0023151 | A1 | | 2/2007 | Judkins | |
| 2007/0039697 | A1 | * | 2/2007 | Sun et al. | 160/84.05 |
| 2007/0074826 | A1 | | 4/2007 | Jelic et al. | |
| 2007/0175593 | A1 | | 8/2007 | Lin | |

FOREIGN PATENT DOCUMENTS

| | | | |
|---|---|---|---|
| WO | 88/07345 | A1 | 10/1988 |
| WO | 93/07353 | A1 | 4/1993 |

OTHER PUBLICATIONS

Roman Shades, seamstobe.com/Romanshades.htm, at least as early as May 26, 2009, 2 pages.

Understand Roman Shades, terrelldesigns.com, at least as early as May 26, 2009, 4 pages.

Chinese Search Report for Application No. 2012800055592, dated Aug. 20, 2014.

* cited by examiner

CELLULAR SHADE HAVING AT LEAST TWO CELLULAR COLUMNS

RELATED APPLICATIONS

The present application is based on and claims priority to U.S. patent application Ser. No. 12/985,971 filed on Jan. 6, 2011 which is incorporated herein by reference in its entirety.

BACKGROUND

Cellular shades have become a popular type of window covering in residential and commercial applications. The shades are aesthetically attractive and also provide improved insulation across a window or other type of opening due to their cellular construction. Cellular shades have assumed various forms, including a plurality of longitudinally extending tubes made of a flexible or semi-rigid material. Cellular shades can, for instance, be mounted at the top of a door or window for extending across an architectural opening. When the shade is in an expanded state, the tubes cover the opening. The shade can be retracted or drawn into a contracted state wherein the tubes collapse into a stack. When viewed from the front (i.e., interior of a room) this stack may have an appearance similar to stacked slats of a Venetian blind. Typically, the width of the stack is half of the overall perimeter of the cell and projects from the glass side to the room side since the cords are normally disposed through the connecting point between each cell.

In the past, individual cells in a cellular shade have been constructed using various techniques and methods. The construction of cellular shades, for instance, is described in U.S. Pat. Nos. 6,767,615; 4,861,404; 4,677,012; 5,701,940; 5,691,031; 4,603,072; 4,732,630; 4,388,354; 5,228,936; 5,339,882; 6,068,039; 6,033,504; and 5,753,338, which are all incorporated herein by reference.

The design emphasis in home and building structures has maintained pressure on the industry to continue to create unique aesthetically attractive coverings for architectural openings. Although the introduction of cellular shades has greatly benefited the industry in this regard, there remains a need to create cellular shades having a unique appearance for providing further options to consumers. For instance, most cellular shades are made with closed cells that have a relatively small volume. Increasing the size of the cells creates configurations that are not aesthetically pleasing, because the cells become two wide for the architectural opening, especially when the shade is retracted. On the other hand, although Roman shades can be made with large billowing front faces, Roman shades do not provide the insulating properties that cellular shades provide and typically do not retract into a tight consolidated configuration. In addition, many Roman shades have drawstrings that remain exposed on the backside of the covering. For safety reasons, these types of shades are not preferred and may in fact not be permitted under local or national laws. Thus, a need exists for a cellular shade assembly capable of having relatively large cells while remaining aesthetically appealing. A need also exists for a cellular shade assembly that not only can accommodate relatively large cells, but also can be made such that the drawstrings are not exposed on any of the surfaces of the shade assembly.

SUMMARY

In general, the present disclosure is directed to a cellular shade that includes at least two columns of cell structures. The first column of cell structures can be integrated with lift cords in a manner such that the lift cords remain enclosed within the individual cells for extending and retracting the shade. The cellular shade further includes a second column of cell structures that can have a size larger than the first cell structures. The second column of cell structures can be positioned offset with respect to the first column of cell structures such that the two columns are nested together. When the cellular shade is extended or retracted, the second cell structures can form a billowing aesthetically pleasing front face, while the second cell structures not only assist in raising and lowering the cellular shade but further provide insulating properties.

For instance, in one embodiment, the present disclosure is directed to a cellular shade that comprises a plurality of first cell structures disposed longitudinally along the shade. The first cell structures are aligned vertically one above each other. For instance, the first cell structures can be connected together along junction lines between adjacent cell structures.

The cellular shade can further include a plurality of second cell structures also disposed longitudinally along the shade and also aligned vertically one above the other. The second cell structures can be positioned offset from the first cell structures such that each second cell structure is positioned in between two adjacent first cell structures. The second cell structures include a first side and a second side. The first side may form the front face of the cellular shade. In one embodiment, the first side of the first cell structures forms the second side of the second cell structures.

The first cell structures and the second cell structures can have a closed position when the shade is retracted and an open position when the shade is extended. In order to extend and retract the shade, the cellular shade can include lift cords for vertically drawing the cell structures from a fully expanded configuration to a fully contracted configuration. The lift cords can extend through the plurality of the first cell structures. In this manner, the lift cords can be integrated into the product and not left exposed on a surface of the product.

Of particular advantage, the cellular shade can be made such that the second cell structures have a size that is much larger than the first cell structures. For instance, the cross sectional area of the second cell structures can be the same or much greater than the cross sectional area of the first cell structures. In one embodiment, for instance, the second cell structures have a first side (which forms the front face of the product) that has a greater material length between the junction lines than the second side. The second side of the second cell structures, on the other hand, can generally have about the same length as both the first side and second side of the first cell structures.

The material length of the first side of the second cell structures can vary depending upon the desired result. In one embodiment, for instance, the first side of the second cell structures can have a material length that is at least 10% greater, such as at least 20% greater, such as at least 30% greater, such as at least 40% greater, such as even 50% greater than the material length of the second side. For example, the first side of the second cell structures can be up to about 200%, such as up to about 150%, such as up to about 100% greater than the material length of the second side. By having the material length of the first side of the second cell structures be greater than the second side of the second cell structures and be greater than the first and second sides of the first cell structures, the first side of the second cell structures forms a unique appearance when viewed from the front of the product. In particular, the first side of the second cell structures can billow and somewhat overlap with each other when the cellular shade is in the fully expanded configuration.

When the cellular shade is retracted, each of the first cell structures and second cell structures can be configured to fold flat into a collapsed stack. In this regard, each of the first cell structures can include a crease line approximately mid-height along the second side. Each of the second cell structures, on the other hand, can define a crease line along the first side at approximately mid-height. Opposite the crease lines of the second cell structure are the junction lines of the first cell structures. Conversely, opposite the crease lines of the first cell structures are the junction lines of the second cell structures. In this manner, when the cellular shade is retracted, the first cell structures collapse and fold along the crease lines and the juncture lines of the second cell structures. The second cell structures, on the other hand, collapse and fold along the crease lines and the juncture lines of the first cell structures.

The manner in which the first cell structures and the second cell structures are constructed can vary depending upon the particular application. In one embodiment, each of the first cell structures can be formed from a single piece of material. With respect to the second cell structures, on the other hand, the first side of the second cell structures can be made from a single piece of material. The second side of the second cell structures, on the other hand, can be formed from two pieces of material. In particular, as described above, the first side of the first cell structures can form the second side of the second cell structures. Thus, when the first cell structures are formed from a single piece of material, the second side of the second cell structures are comprised of two separate pieces of material that each form a complete first cell structure.

In the above embodiment, in order to improve the integrity of the overall cellular configuration, the different pieces of material can be connected together along the juncture lines in an offset relationship. For instance, the first side of the second cell structures can comprise a first segment separated from a second segment by the crease lines. The first segment of the first side can have a length that is less than the length of the second segment of the first side. Similarly, the first cell structures can also be formed from a first segment separated from a second segment by the crease lines that are formed on the second side of the first cell structures. The first segment of the first cellular structures can have a length that is greater than the length of the second segment of the first cell structures. When the first and second cell structures are integrated together, the first segment of the second cell structures can transition into the second segment of the first cell structures, while the second segment of the first cell structures can transition into the first segment of the first cell structures. As will be described in greater detail below, the above arrangement allows for better attachment between the cell structures at the junction lines of the second cell structures for increasing the overall integrity of the product.

Other features and aspects of the present disclosure are discussed in greater detail below.

BRIEF DESCRIPTION OF THE DRAWINGS

A full and enabling disclosure of the present invention, including the best mode thereof to one skilled in the art, is set forth more particularly in the remainder of the specification, including reference to the accompanying figures, in which.

Figure 1:
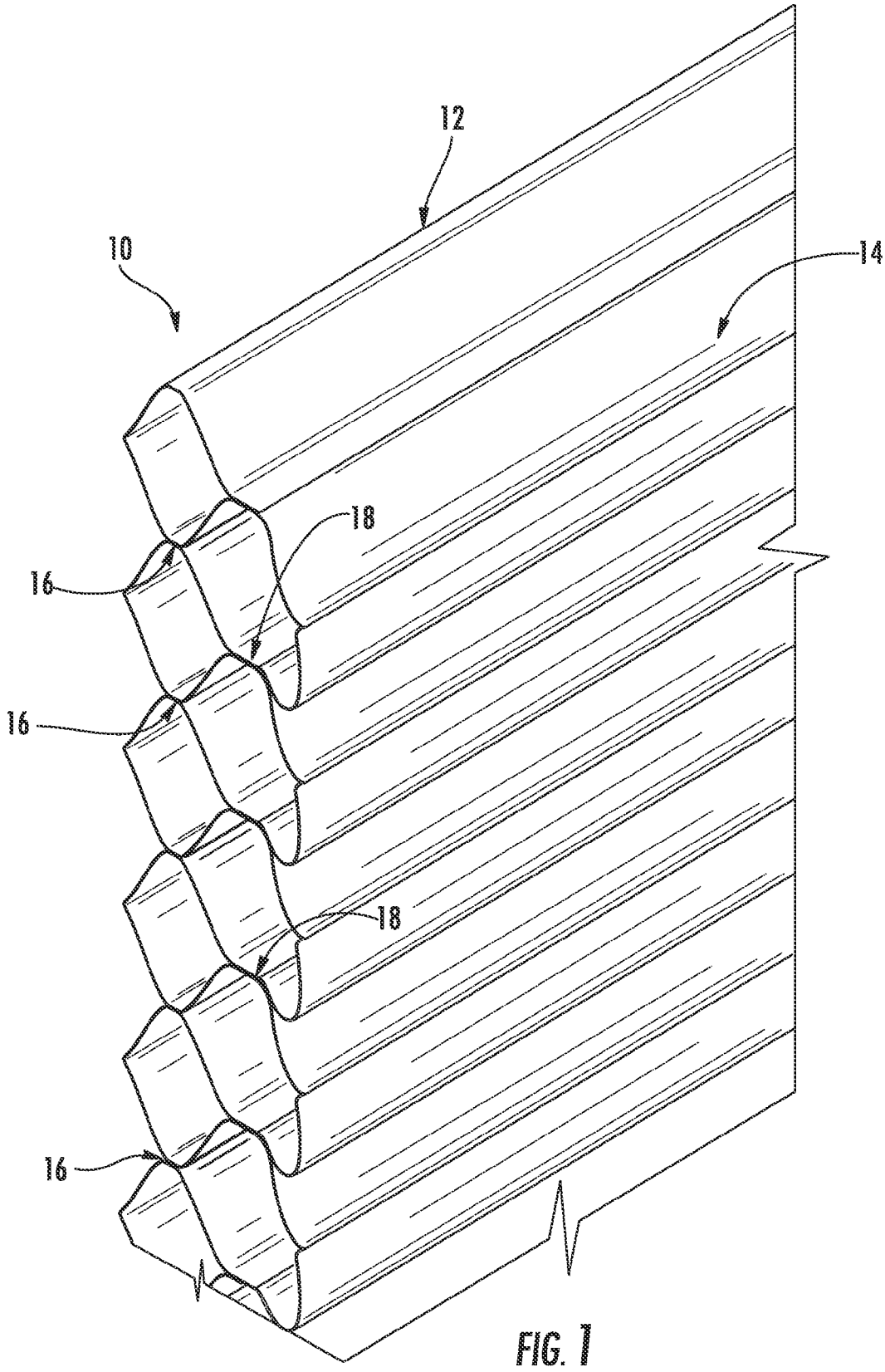
FIG. 1 is a partial perspective view of one embodiment of a cellular shade made in accordance with the present disclosure.

Repeat use of reference characters in the present specification and drawings is intended to represent the same or analogous features or elements of the present invention.

DETAILED DESCRIPTION

It is to be understood by one of ordinary skill in the art that the present discussion is a description of exemplary embodiments only, and is not intended as limiting the broader aspects of the present disclosure.

In general, the present disclosure is directed to cellular shade assemblies that can be mounted in an architectural opening, such as a window or door, for blocking light, providing privacy, increasing the aesthetic appeal of a room and/or allowing a desired amount of light into a room. The present disclosure is particularly directed to cellular shade assemblies that include multiple vertical columns of cellular structures.

Cellular shades made according to the present disclosure offer various advantages and benefits. For instance, as described above, cellular shades of the present disclosure generally include adjacent vertical columns of cell structures. One column of the cell structures forms a face of the product and can provide the product with an overall appealing look. Another column of cell structures, on the other hand, can be used to provide support for the cell structures that form the face of the product. For instance, the column of cell structures that forms a back of the product can be used to encase drawstrings that are used to raise and lower the shade assembly. By encasing the drawstrings within the cellular structures, the drawstrings do not remain exposed which otherwise may make the drawstrings prone to tangling with each other or other objects. The back column of cellular structures also allows for the cellular shade to assume a relatively compact shape when in the fully retracted position. In particular, the back column of cell structures can form a flat horizontal stack that supports the other column of cell structures that form the face of the product.

As will be described in greater detail below, the cellular shade of the present disclosure can be constructed in a manner such that multiple pieces of fabric can be used to construct the different cell structures. The different fabrics can be combined for increasing the overall aesthetic appeal of the product and/or for adjusting the amount of light that passes through the shade assembly. In addition, the columns of cell structures can be integrated together in a manner that provides the product with great strength properties not only in the vertical direction, but also in the horizontal direction.

Referring to FIGS. 1 through 5, one embodiment of an expandable and contractable cellular shade 10 made in accordance with the present disclosure is shown. In FIG. 1, a portion of the cellular shade is illustrated, which can be mounted within a window or other architectural opening as may be desired. For instance, in one embodiment, the cellular shade 10 can be placed in operative association with a head rail assembly that is then mounted within an architectural opening. It should be understood, however, that the cellular shade 10 is not limited in its particular use as a window or door shade, and may be used in any application as a covering, partition, shade, or the like in any type of architectural opening in a building or structure.

As shown in FIGS. 1 through 4, the cellular shade 10 includes a plurality of first cell structures 12 that are disposed longitudinally along a width dimension of the cellular shade so as to extend across a desired distance, such as across the expanse of a window. The first cell structures 12 are aligned vertically one above another with junction lines 16 defined between adjacent cell structures 12.

In the embodiment illustrated, the cellular shade 10 further includes a second column of cell structures 14 positioned adjacent to the first column of cell structures 12. The second cell structures 14 are also disposed longitudinally along a width dimension of the shade assembly. The second cell structures 14 are aligned vertically one above another with juncture lines 18 defined between adjacent cell structures 14.

In the embodiment illustrated in FIGS. 1 through 5, the cellular shade 10 includes two different columns of cell structures. It should be understood, however, that the cellular shade may include further columns of cell structures as desired.

Figure 2:
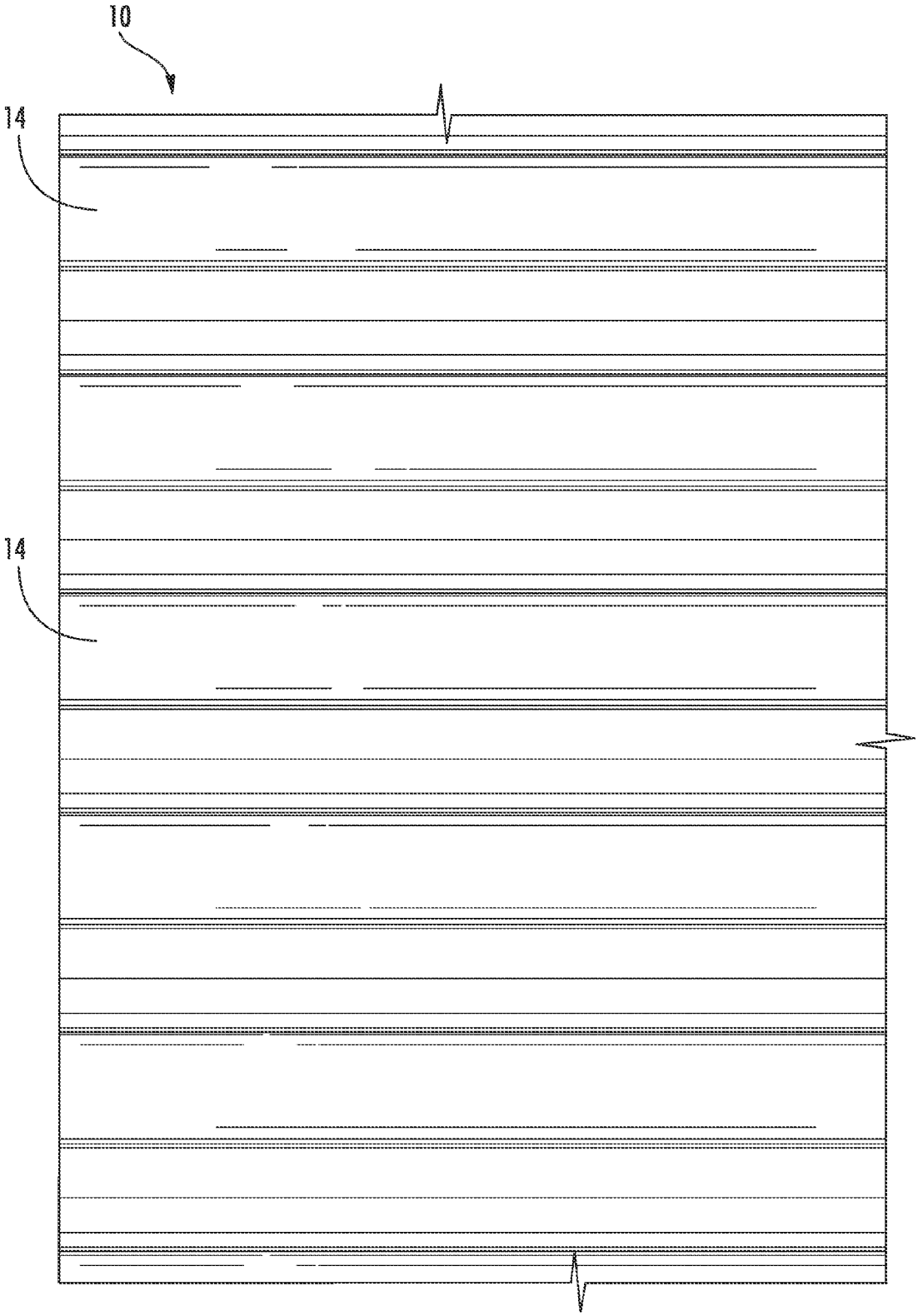
FIG. 2 is a plan view of one side of the cellular shade illustrated in FIG. 1.
Figure 3:
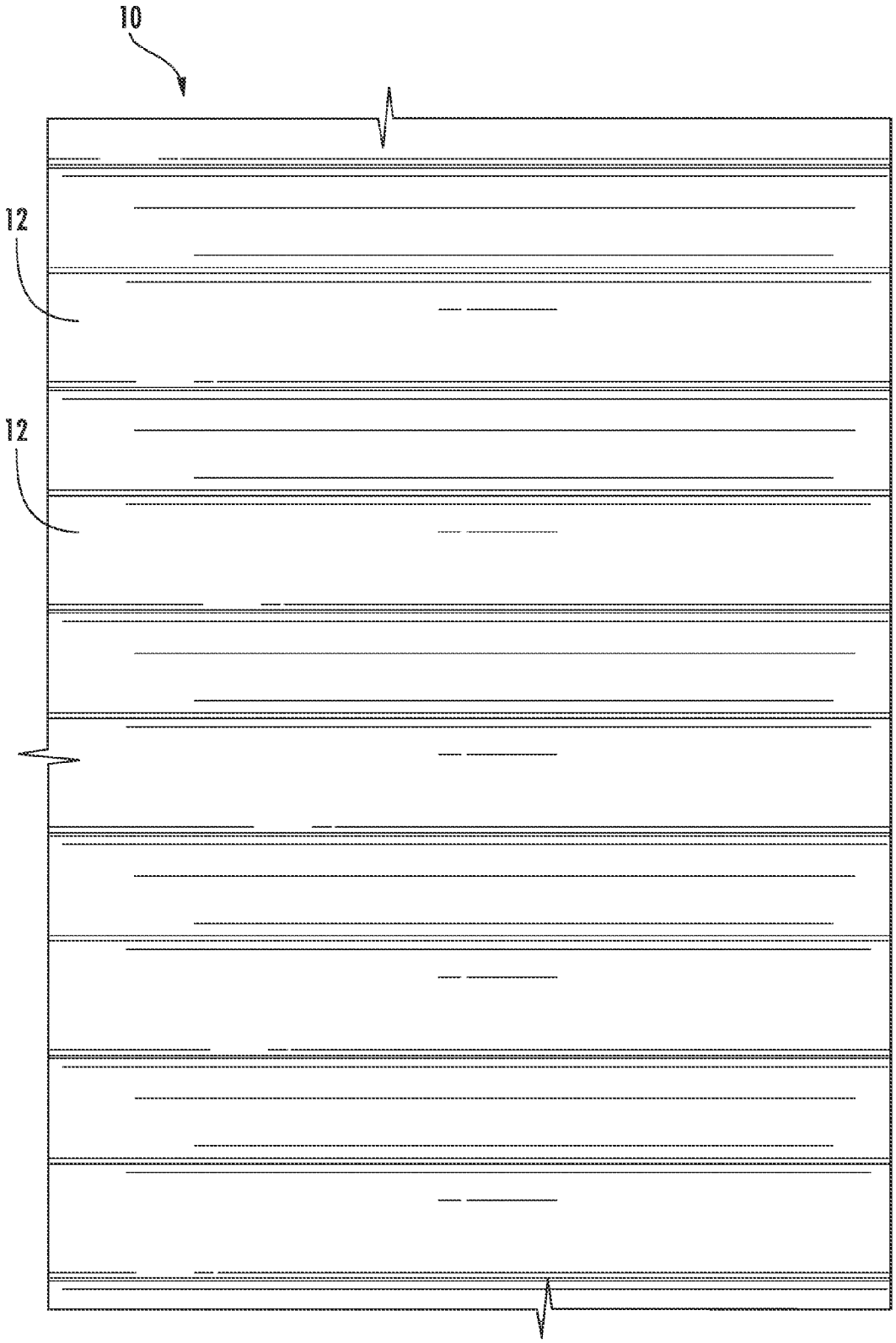
FIG. 3 is a plan view of the opposite side of the cellular shade illustrated in FIG. 1.
Figure 4:
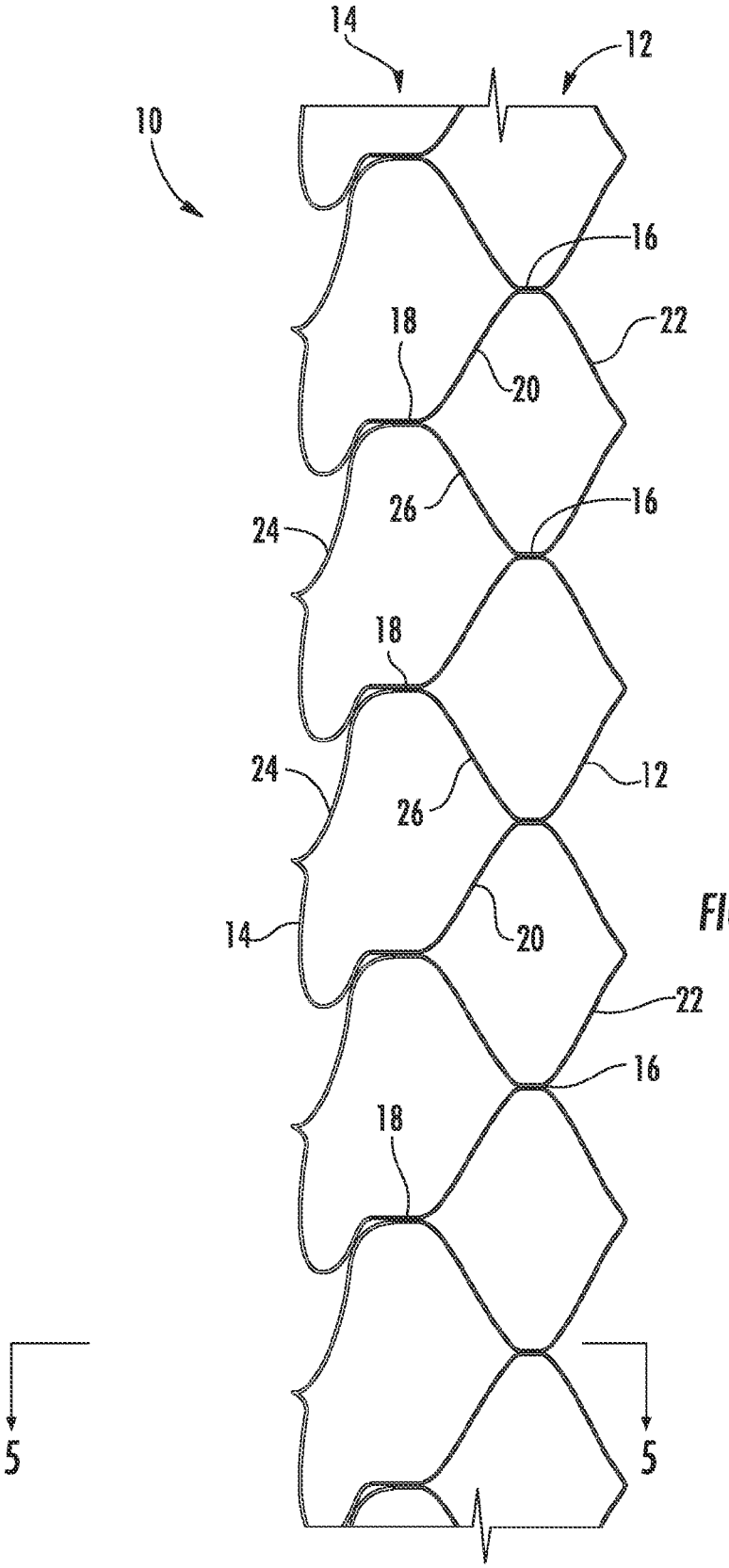
FIG. 4 is a partial side view of the cellular shade illustrated in FIG. 1.
Figure 5:
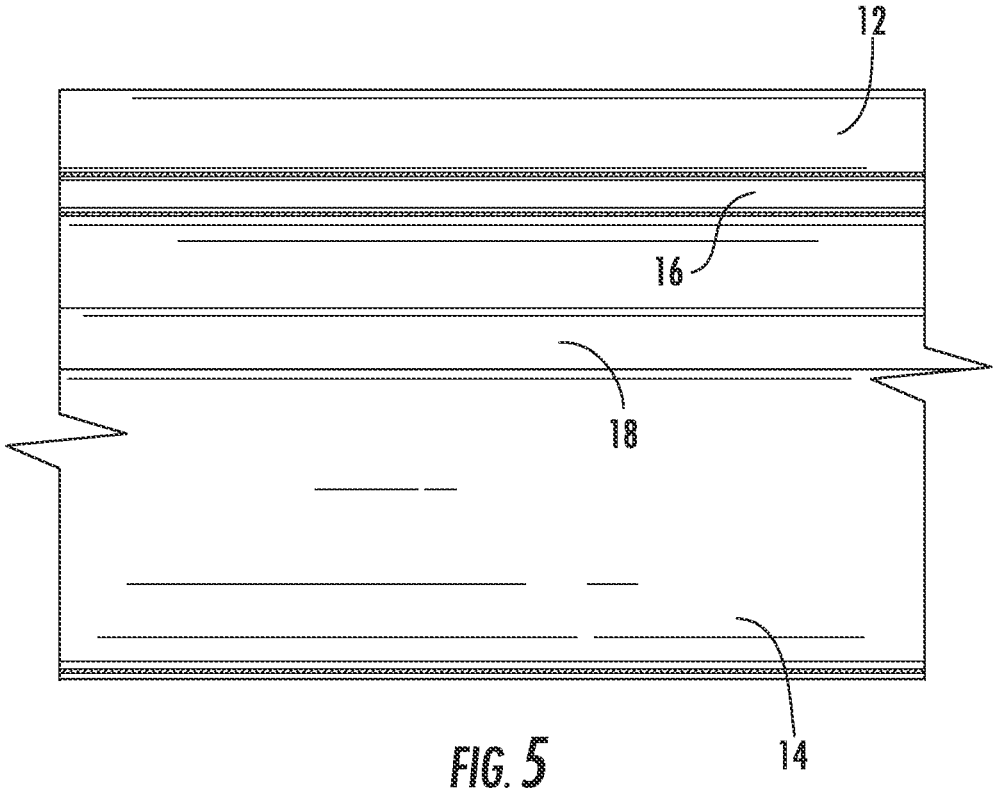
FIG. 5 is a cross-sectional view along line 5-5 of FIG. 4.

As shown particularly in FIGS. 1 and 4, the first cell structures 12 form one face of the cellular shade 10, while the second cell structures 14 form an opposite face of the cellular shade. In one embodiment, for example, the second cell structures may form the front face of the cellular shade, while the first cell structures 12 may form the back face of the cellular shade. The back face, for instance, may face a window or other opening, while the front face of the product can face the interior of a room. The face of the cellular shade 10 formed by the second cell structures is generally illustrated in FIG. 2, while the face of the cellular shade 10 formed by the first cell structures is generally shown in FIG. 3.

As depicted in the various figures, each of the first cell structures 12 and the second cell structures 14 are generally illustrated as being "closed" in that the cell structures are defined by a continuous, unbroken circumferential wall. It should be understood, however, that the cellular shade may also be made such that the first cell structures and/or the second cell structures are not closed and have a discontinuous circumferential wall, while still retaining a cell-like shape and appearance.

The cell structures 12 and 14 can be made from a single piece of material or fabric or may be made from multiple pieces of a material or fabric. The material or fabric may be flexible or semi-rigid. A flexible material is capable of being folded or flexed and includes such materials as woven, knitted or non-woven fabrics, vinyl or film sheets, cords of natural or synthetic fibers, monofilaments, and the like. A semi-rigid material, on the other hand, is somewhat stiffer, but is still flexible or foldable to some degree. Examples of semi-rigid materials include reinforced fabrics, polyvinyl chloride films, and so forth. It should be readily appreciated, however, that the first cell structures 12 and the second cell structures 14 can be made from any suitable material or fabric.

Referring to FIGS. 1 and 4, the interrelationship between the first cell structures 12 and the second cell structures 14 is illustrated. As shown, the first cell structures 12 include a first side 20 opposite a second side 22. The first side 20 and the second side 22 extend between adjacent junction lines 16. In the embodiment illustrated, the first side of the first cell structures 12 is approximately the same size or length as the second side 26 when measured along a vertical axis that intersects the center of the junction line 16. In this manner, the first cell structures are generally symmetrical about a vertical axis or a vertical plane that intersects the junction line 16 in a horizontal direction or in a direction that is perpendicular to the cross-sectional view (side view) illustrated in FIG. 4.

The second cell structures 14 also include a first side 24 and a second side 26. As shown, each of the second cell structures 14 are positioned offset from the first cell structures 12 such that each of the second cell structures is positioned in between two adjacent first cell structures. Further, the first side 20 of the two adjacent first cell structures 12 forms the second side 26 of each of the second cell structures 14. In other words, the second cell structures 14 are each nested in between two adjacent first cell structures 12. As illustrated in FIGS. 1 and 4, this arrangement gives the cellular shade 10 an overall integrated look.

As described above, in the embodiment illustrated in FIGS. 1 and 4, the first side 20 of the first cell structures 12 is generally about the same length as the second side 22 of the first cell structures 12, which forms a generally symmetrical cell. The second cell structures 14, on the other hand, can be symmetrical or can be non-symmetrical. In the embodiment illustrated in the figures, for instance, the second cell structures 14 are formed such that the first side 24 of the cell structures has a material length that is greater than the material length of the second side 26 when measured from adjacent junction lines 18. For example, the first side 24 of the second cell structures 14 may have a material length that is at least about 10% greater, such as at least about 30% greater, such as at least about 50% greater, such as at least about 70% greater, such as at least about 100% greater than the material length of the second side 26. The limits of the material length of the second side can vary depending upon the relative proportions of the size of the first cell structures 12. For many applications, for instance, the second side 26 of the second cell structures 14 can be up to about 1,000% greater, such as up to about 800% greater, such as up to about 600% greater, such as up to about 500% greater, such as up to about 200% greater than the material length of the second side 26 of the second cell structures 14.

By having the first side 24 of the second cell structures 14 be greater in length than the length of the second side 26 of the second cell structures 14, various advantages and benefits may be obtained with respect to the appearance of the product. As shown particularly in FIGS. 1 and 4, for instance, increasing the length of the first side 24 creates cell structures 14 having an increased cross-sectional area. When viewed from the front face of the cellular shade 10, the relatively large cellular structures can provide a Roman-like look with large billowing cells projecting from the shade.

Although the second cell structures 14 can provide the cellular shade 10 with an overall unique and aesthetic look, the first cell structures 12 are not only present to further enhance the aesthetic appeal of the product, but also to support the second cell structures 14, especially when the second cell structures are oversized.

In one embodiment, as described above, the cellular shade 10 can include a head rail that is adapted to be mounted to the frame structure of a window, door or other type of opening. The head rail may include an extruded longitudinally extending component that includes any number of chambers, channels or other features necessary for incorporating a lift system, such as cords, pulleys and the like, for raising and lowering the cellular shade between a fully expanded configuration as shown in FIGS. 1, 4 and 7 and a fully retracted configuration as illustrated in FIG. 8.

Figure 7:
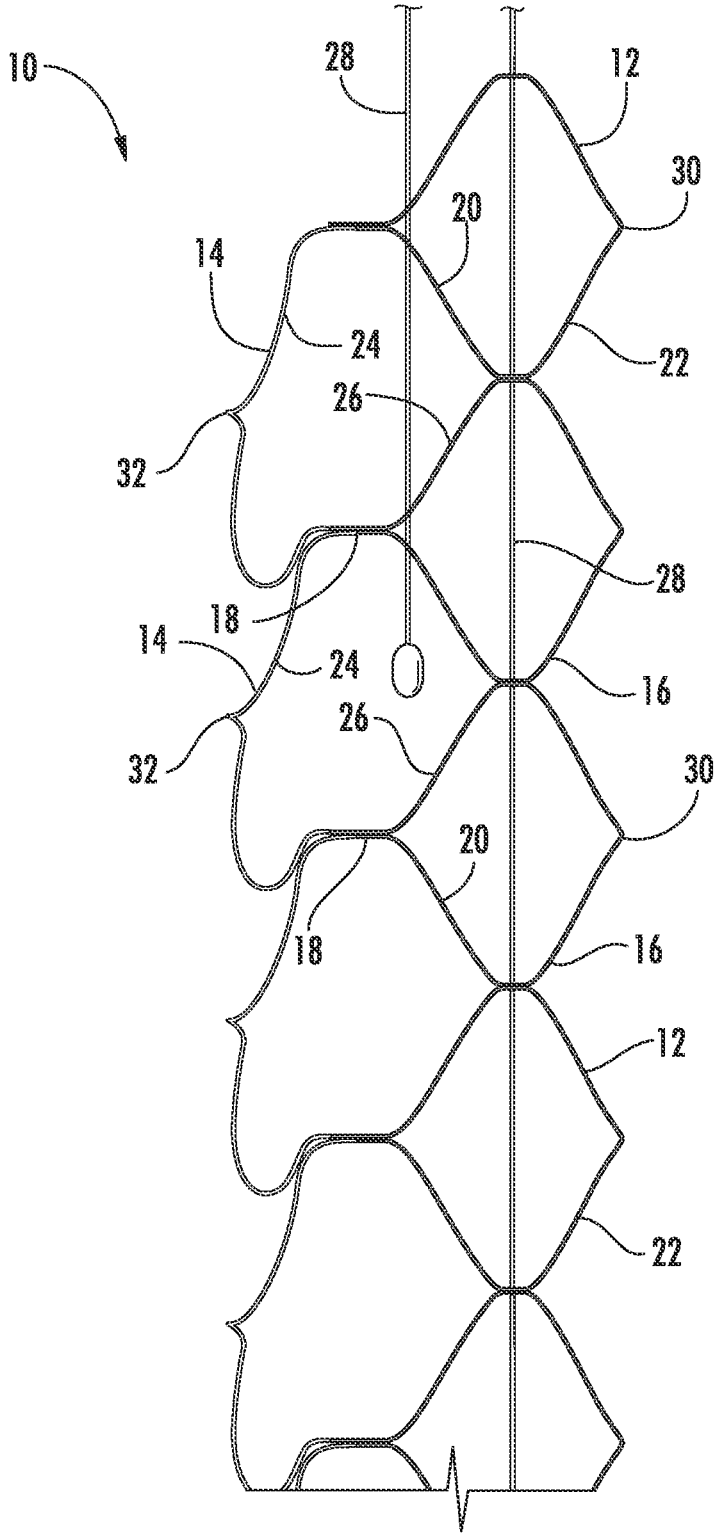
FIG. 7 is a partial side view of an embodiment of a cellular shade made in accordance with the present disclosure illustrating drawstrings.
Figure 8:
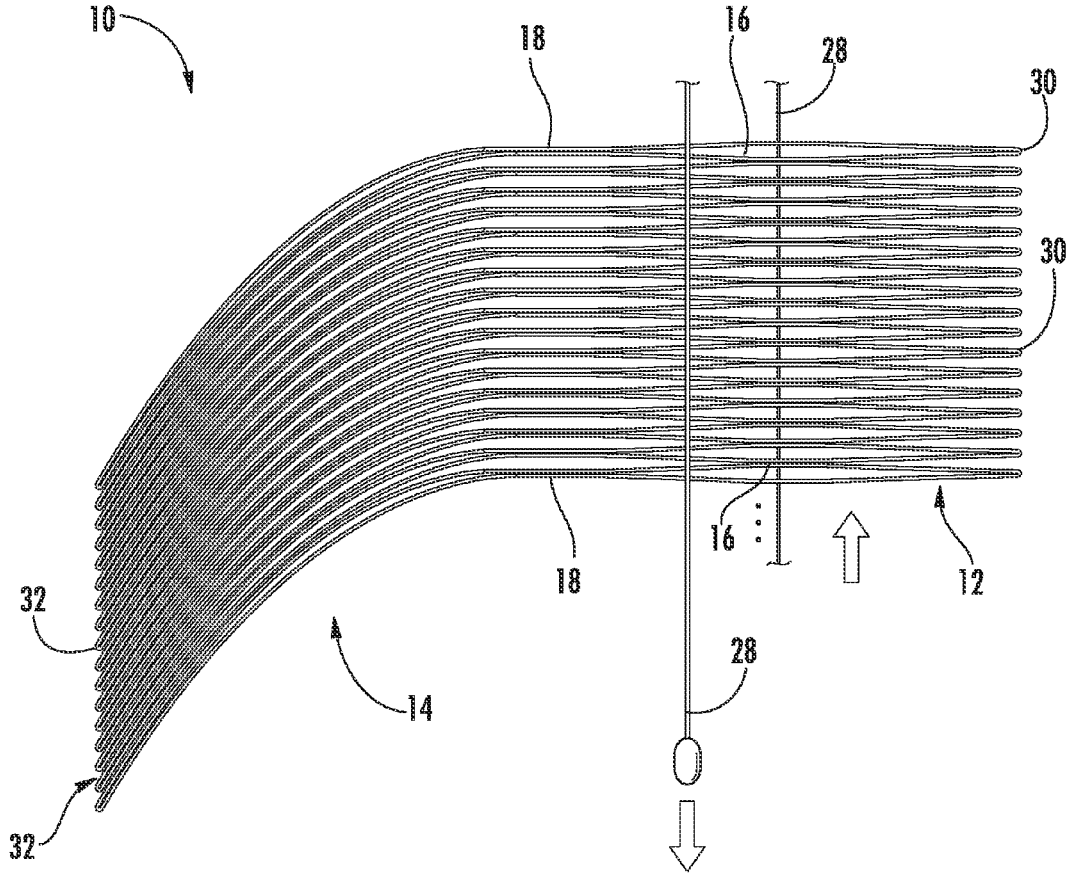
FIG. 8 is a side view of the cellular shade illustrated in FIG. 7 shown in the retracted position.

Referring to FIGS. 7 and 8, in order to adjust the cellular shade 10 between an extended position and a collapsed position, the cellular shade can include a plurality of lift cords 28. Various cord-type lift systems are well known in the art and any one of these types of systems may be configured or utilized for use with the cellular shade 10. In the embodiment illustrated in FIGS. 7 and 8, the lift cords 28 are disposed vertically intersecting each of the first cell structures 12. In particular, the lift cords 28 extend through the first cell structures 12 from the top of each cell structure to the bottom of each cell structure and generally lie in a plane that intersects the closed cell structures 12 along the junction lines 16 in between the first side 20 and the second side 22 of the first cell structures 12. In this manner, the lift cords 28 remain encased within the product except along the front face of the product where the lift cords are grasped by a user. By remaining contained within the first cell structures 12, the lift cords 28 are prevented from entangling with each other or with any other objects that may come in contact with the cellular shade.

In addition to encasing the lift cords 28, the first cell structures 12 also serve to support the second cell structures 14 when the cellular shade 10 is retracted into a fully closed position as shown in FIG. 8. In particular, the first cell structures assume a flat configuration when the cellular shade is retracted. Ultimately, the first cell structures 12 form a flat stack that then allows the second cell structures to drape or droop over the stack and remain within the architectural opening without requiring that the architectural opening have a significant amount of depth in order to accommodate the product.

As shown in FIGS. 7 and 8, in order for the first cell structures 12 to collapse and fold flat when the cellular shade 10 is retracted, each of the first cell structures 12 includes a crease line 30 located on the second side of each cell structure. The crease line is positioned approximately mid-height on the second side 22 of the cell structures 12 in between the junction lines 16. The crease lines 30 are also positioned generally opposite the junction lines 18 of the second cell structures 14.

Optionally, the second cell structures 14 can also include crease lines 32 located along the first side 24 of the second cell structures 14. The crease lines 32 are positioned approximately mid-height between the junction lines 18. Also, the crease lines 32 are generally positioned opposite the junction lines 16 of the first cell structures 12.

When the cellular shade 10 is retracted as shown in FIG. 8, the first cell structures collapse along the crease lines 30 on one side and along the junction lines 18. Similarly, the second cell structures 14 collapse along the crease lines 32 and the junction lines 16. In this manner, as shown in FIG. 8, the first cell structures 12 and the second cell structures 14 form a stack of folded cells. The cellular shade 10 is held within an architectural opening by the lift cords 28 pushing against the stack of the first cell structures 12. In one embodiment, the stack of first cell structures 12 may be held against a head rail assembly (not shown). The stack of second cell structures 14 as shown in FIG. 8 tend to droop and hang in a downward direction, depending upon the material used to make the cell structures. By hanging down in a downwardly direction, not only does the stack of the second cell structures 14 not project into the interior of a room, but also provides the shade assembly with an appealing aesthetic look when the cellular shade is fully retracted.

In an alternative embodiment, the second cell structures 14 may not include the crease lines 32. In this embodiment, the second cell structures 14 will form overlapping billows when the cellular shade is retracted.

The manner in which the first cell structures 12 and the second cell structures 14 are constructed can depend upon the particular application and the desired result. In one embodiment, for instance, the entire cellular shade 10 can be made from a single continuous piece of material. Alternatively, different pieces of material can be used to construct the different cell structures.

Figure 6A:
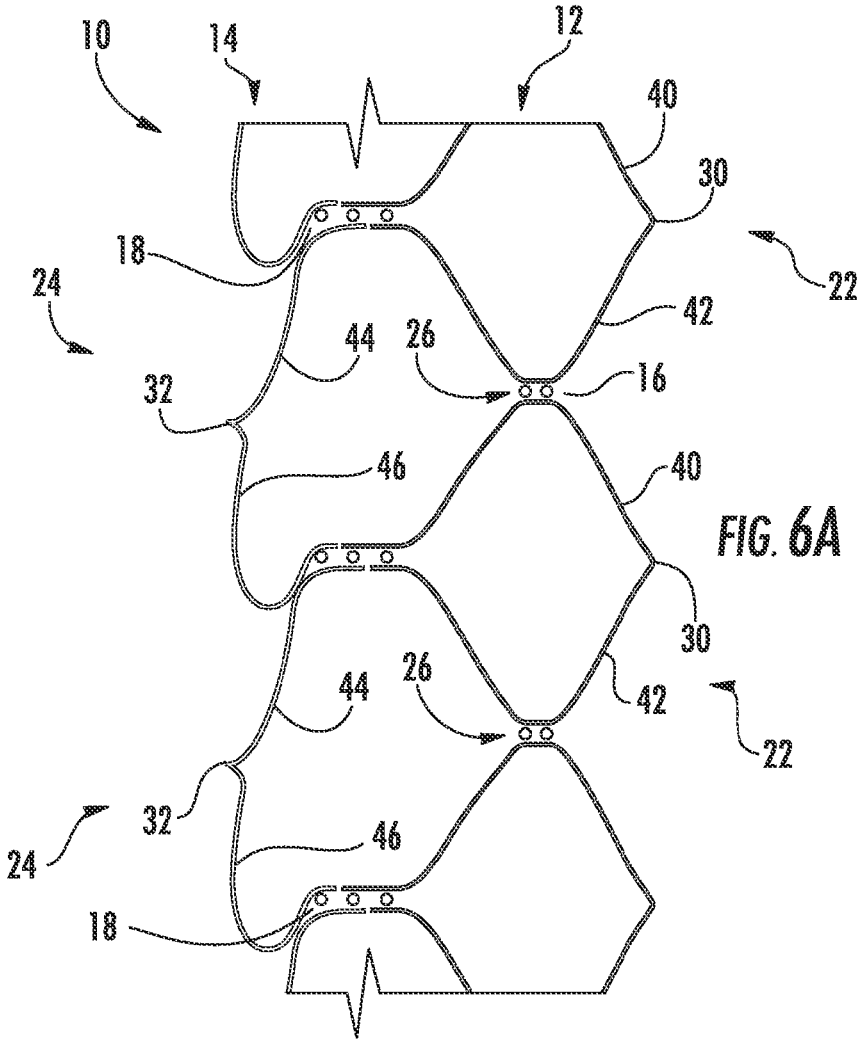
FIGS. 6A and 6B are cross-sectional views of one embodiment of a cellular shade made in accordance with the present disclosure illustrating the juncture lines that attach the column of cells together.
Figure 6B:
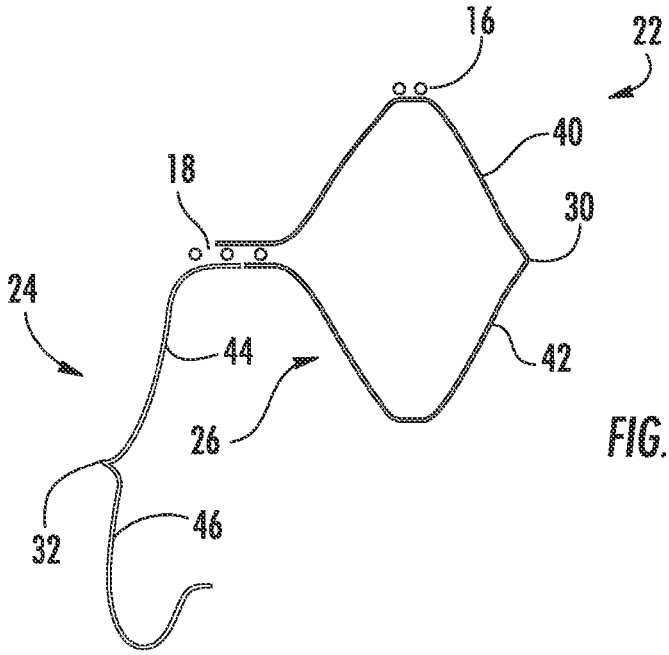

Referring to FIGS. 6A and 6B, for instance, one embodiment for constructing the cell structures 12 and 14 is shown in greater detail. In the embodiment illustrated, the first cell structures 12 are made from a single piece of material, while the second cell structures 14 are each made from three different pieces of material.

For instance, the first cell structures 12 are made from a single piece of material in which the crease line 30 divides the material into a first segment 40 and a second segment 42. The individual first cell structures 12 are connected to each other along the junction lines 16. In addition, the first segment 40 is attached to the second segment 42 at the junction lines 18 to form closed cell structures.

As also shown in FIGS. 6A and 6B, the second cell structures 14 can be made from a first piece of material that defines the crease lines 32. The crease lines 32 divide the piece of material into a first segment 44 and a second segment 46. The first segment 44 and the second segment 46 form the front face of the cellular shade 10 and the first side 24 of the second cell structures 14. The second side 26 of each of the second cell structures 14, on the other hand, is formed by two adjacent first cell structures 12. Thus, each of the second cell structures 14 is comprised of three separate pieces of material.

In accordance with the present disclosure, due to the manner in which the adjacent cells are attached together, the first segment 40 of each of the first cell structures 12 is longer in length than the second segment 42 of each of the second cell structures 14. Further, the first segment 44 of each of the second cell structures 14 is longer in length than the second segment 46 of each of the second cell structures 14. The ends of each of the segments 40, 42, 44 and 46 converge and are attached to each other along the junction lines 18. Specifically, in the embodiment illustrated, the second segment 46 of the second cell structures 14 is attached to the first segment 44 of an adjacent (in this embodiment lower) second cell structure 14. The first segment 40 of each of the first cell structures 12, on the other hand, is attached not only to the second segment 42 of the same cell structure 12, but is also attached to the first segment 44 of an adjacent second cell structure 14 that, in this embodiment, lies below the first cell structure 12. In this manner, the first segment 40 of each of the first cell structures 12 transitions into an adjacent second segment of a second cell structure 14, while the second segment 42 of each of the first cell structures 12 transitions into an adjacent lower first segment 44 of a second cell structure 14.

As shown in FIGS. 6A and 6B, the junction lines 16 and 18 may comprise one or more beads of adhesive that extend along the length of the product. It should be understood, however, that any suitable attachment structure may be used to form the junction lines, such as stitches. In an alternative embodiment, the cell structures may be attached to each other using a single bead of adhesive that extends the entire width of the junction lines.

The manner in which the first cell structures 12 and the second cell structures 14 are assembled together as shown in FIGS. 6A and 6B can provide various advantages and benefits. For instance, the attachment configuration provides for two columns of integrated and interconnected cell structures wherein the entire cellular shade 10 has excellent strength properties, especially in the vertical direction.

The junction lines 16 and 18 not only connect the cellular structures together and assist in collapsing the cells when the cellular shade is retracted, but also assist in providing the overall shape of the cell structures when in the expanded configuration. The attachment points, for instance, provide the cell structures with a cross section that has a hexagon-like shape. In this regard, the shape of the cell structures can be modified by increasing or decreasing the width of the attachment points between adjacent cell structures.

In the embodiment illustrated in FIG. 6A, the first segment 40 of the first cell structures 12 and the first segment 44 of the second cell structures 14 are generally longer than the second segments 42 and 46. It should be understood, however, that the arrangement may be reversed such that the first segments 40 and 44 are shorter than the second segments 42 and 46.

As shown in FIGS. 6A and 6B, the front face of the second cell structures 14 is made from a separate piece of material than the first cell structures 12 and the remainder of the second cell structures 14. In one embodiment, the entire cellular shade can be made from the same type of material. In other embodiments, however, the front face of the second cell structures may be made from a different material than the remainder of the cellular shade. Different materials or fabrics, for instance, can be combined together to produce a shade assembly having desired characteristics and properties.

In one embodiment, for instance, the front face of the cellular shade can be made from a material that does not permit significant amounts of light to pass through the material, while the first cell structures 12 can be made from a material that allows much larger quantities of light to pass through the material. In this manner, the front face may appear to illuminate when the shade assembly is in an extended position and light, such as sunlight, is striking the shade from the back side. In the above embodiment, for instance, the first cell structures 12 may be made from a fabric having a relatively open weave, such as a sheer material made from monofilaments or may comprise a film. The front face or first side 24 of the second cell structures 14, on the other hand, may comprise a woven fabric, a knitted fabric, or a non-woven fabric such as a hydroentangled web.

These and other modifications and variations to the present invention may be practiced by those of ordinary skill in the art, without departing from the spirit and scope of the present invention, which is more particularly set forth in the appended claims. In addition, it should be understood that aspects of the various embodiments may be interchanged both in whole or in part. Furthermore, those of ordinary skill in the art will appreciate that the foregoing description is by way of example only, and is not intended to limit the invention so further described in such appended claims.

What is claimed:

1. A process for producing a cellular shade comprising:

forming a plurality of first cell structures from a first material that are disposed longitudinally along a width dimension and are aligned vertically one above another, each of the first cell structures including a first side and a second side extending between an upper first junction line and a lower first junction line, each of the first cell structures being coupled to adjacent first cell structures at the upper and lower first junction lines, and forming a plurality of second cell structures also disposed longitudinally along the width dimension, the second cell structures being formed offset from the first cell structures such that each second cell structure is positioned in between two adjacent first cell structures, the second cell structures including a first side and a second side extending between an upper second junction line and a lower second junction line, each of the second cell structures being coupled to adjacent second cell structures at the upper and lower second junction lines, the first side of the first cell structures forming the second side of the second cell structures, the first side of the second cell structures being made from a second material, the first cell structures including crease lines that allow the first cell structures to collapse into a closed position, wherein the second side of each second cell structure extending between the upper and lower second junction lines is formed entirely of the first material, wherein the second side of each second cell structure extending between the upper and lower second junction lines is formed entirely of the first material of two adjacent first cell structures.

2. A process as defined in claim 1, wherein each first cell structure is formed from a separate and single piece of material comprising the first material.

3. A process as defined in claim 2, wherein the first side of each of the second cell structures is comprised of a separate and single piece of material comprising the second material.

4. A process as defined in claim 1, wherein larger quantities of light can pass through the first material in comparison to the second material.

5. A process as defined in claim 1, wherein the first material comprises a sheer material while the second material comprises a woven fabric, a knitted fabric, or a non-woven fabric.

6. A process as defined in claim 5, wherein the second material comprises a hydro-entangled web.

7. A cellular shade comprising:

a plurality of first cell structures disposed longitudinally along the shade, the first cell structures being aligned vertically one above another, each of the first cell structures including a first side and a second side extending between an upper first junction line and a lower first junction line, each of the first cell structures being coupled to adjacent first cell structures at the upper and lower junction lines, wherein the first side of each of the first cell structures has approximately the same material length as the second side of each of the first cell structures, the first cell structures being comprised of a first material; and a plurality of second cell structures also disposed longitudinally along the shade and also being aligned vertically one above another, the second cell structures being positioned offset from the first cell structures such that each second cell structure is positioned in between two adjacent first cell structures, each of the second cell structures including a first side and a second side extending between an upper second junction line and a lower second junction line, each of the second cell structures being coupled to adjacent second cell structures at the upper and lower second junction lines, wherein the first side of each of the second cell structures has a material length that is greater than the material length of the second side of each of the second cell structure, and wherein the first side of the first cell structures forms the second side of the second cell structures, the first side of the second cell structures comprising a second material that is different than the first material, and wherein the first cell structures and the second cell structures have a dosed position when the shade is retracted and an open position when the shade is extended, wherein the material length for the first side of each of the second cell structures is selected such that a portion of the first side of each second cell structure overlaps a portion of the first side of an adjacent second cell structure.

8. A cellular shade as defined in claim 7, further comprising lift cords for vertically drawing the cellular shade from a fully expanded configuration to a fully contracted configuration, the lift cords extending through the plurality of first cell structures.

9. A cellular shade as defined in claim 7, wherein the first cell structures are completely closed.

10. A cellular shade as defined in claim 9, wherein the second cell structures are completely closed.

11. A cellular shade as defined in claim 7, wherein each of the first cell structures includes a crease line located on the second side, and wherein the first cell structures collapse into a flat configuration along the crease lines.

12. A cellular shade as defined in claim 11, wherein each of the second cell structures includes a crease line located on the first side, and wherein the second cell structures collapse into a flat configuration along the crease lines.

13. A cellular shade as defined in claim 7, wherein the first side of the second cell structures has a material length that is at least 30% longer than the material length of the second side of the second cell structures.

14. A cellular shade as defined in claim 7, wherein the first side of each of the second cell structures includes a first segment separated from a second segment along a crease line, and wherein the first segment of the first side has a length less than the length of the second segment of the first side.

15. A cellular shade as defined in claim 14, wherein the first segment of the first side of the second cell structures is above the second segment of the first side in the longitudinal direction.

16. A cellular shade as defined in claim 14, wherein the first segment of the first side of the second cell structures is below the second segment of the first side in the longitudinal direction.

17. A cellular shade as defined in claim 7, wherein each first cell structure is made from a single piece of material comprising the first material and wherein the second cell structures are offset from the first cell structures such that the second side of each second cell structure is comprised of two separate pieces of material that each form a complete first cell structure.

18. A cellular shade as defined in claim 14, wherein each first cell structure is made from a single piece of material comprising the first material and wherein the second cell structures are offset from the first cell structures such that the second side of each second cell structure is comprised of two separate pieces of material that each form a complete first cell structure.

19. A cellular shade as defined in claim 17, wherein the first side of each of the second cell structures is comprised of a single piece of material comprising the second material.

20. A cellular shade as defined in claim 18, wherein the first cell structures fold along the crease lines of the second cell structures when in the closed position.

21. A cellular shade as defined in claim 7, wherein each of the first cell structures are made from a single piece of material, each of the first cell structures including a first segment separated by a second segment by a crease line located on the second side of each of the first cell structures, and wherein the first segment has a length less than the length of the second segment.

22. A cellular shade comprising:

a plurality of first cell structures disposed longitudinally along the shade, the first cell structures being aligned vertically one above another, each of the first cell structures including a first side and a second side extending between an upper first junction line and a lower first junction line, each of the first cell structures being coupled to adjacent first cell structures at the upper and lower first junction lines, the first cell structures being comprised of a first material; and a plurality of second cell structures also disposed longitudinally along the shade and also being aligned vertically one above another, the second cell structures being positioned offset from the first cell structures such that each second cell structure is positioned in between two adjacent first cell structures, each of the second cell structures including a first side and a second side extending between an upper second junction line and a lower second junction line, each of the second cell structures being coupled to adjacent second cell structures at the upper and lower second junction lines, the first side of the first cell structures forming the second side of the second cell structures, the first side of the second cell structures being made from a second material that is different than the first material, wherein the first side of each second cell structure extending between the upper and lower second junction lines is formed entirely of the first material.

23. The cellular shade as defined in claim 22, wherein each first cell structure is formed from a separate and single piece of material comprising the first material.

24. The cellular shade as defined in claim 23, wherein the first side of each of the second cell structures is comprised of a separate and single piece of material comprising the second material.

25. The cellular shade as defined in claim 22, wherein larger quantities of light can pass through the first material in comparison to the second material.

26. The cellular shade as defined in claim 22, wherein the first material comprises a sheer material while the second material comprises a woven fabric, a knitted fabric, or a nonwoven fabric.

27. The cellular shade as defined in claim 22, wherein the second material comprises a hydro-entangled web.

* * * * *

UNITED STATES PATENT AND TRADEMARK OFFICE

CERTIFICATE OF CORRECTION

PATENT NO. : 9,157,272 B2
APPLICATION NO. : 14/010804
DATED : October 13, 2015
INVENTOR(S) : John D. Rupel It is certified that error appears in the above-identified patent and that said Letters Patent is hereby corrected as shown below:

In the claims

Column 10, line 64, claim 7, the term “dosed position” should read --closed position--.

Column 12, line 37, claim 22, the term “first material” should read --second material--.

Signed and Sealed this
Fifth Day of April, 2016

Michelle K. Lee

Michelle K. Lee
*Director of the United States Patent and Trademark Office*